United States Patent [19]

Schneider et al.

[11] Patent Number: 4,871,061

[45] Date of Patent: Oct. 3, 1989

[54] FURNITURE CONTAINER

[75] Inventors: Stanley A. Schneider, Jasper; John G. Knust, Ferdinand, both of Ind.

[73] Assignee: Kimball International, Inc., Jasper, Ind.

[21] Appl. No.: 230,784

[22] Filed: Aug. 10, 1988

[51] Int. Cl.[4] ..... B65D 85/00

[52] U.S. Cl. ..... 206/326; 206/491; 229/23 R

[58] Field of Search ..... 206/326, 491; 229/8, 229/16 R, 23 R

[56] References Cited

U.S. PATENT DOCUMENTS

| | | | |
|---|---|---|---|
| 1,188,825 | 6/1916 | Potter . | |
| 1,686,834 | 2/1925 | Nickerson . | |
| 2,015,278 | 9/1935 | Meyer | 229/8 |
| 2,068,095 | 1/1936 | Weltzien . | |
| 2,331,753 | 6/1940 | Wohlers . | |
| 2,346,003 | 7/1942 | Bishop . | |
| 2,675,955 | 10/1949 | Gibbons . | |
| 4,098,401 | 7/1978 | Brown et al. . | |
| 4,111,301 | 9/1978 | English . | |
| 4,114,755 | 9/1978 | Aust | 206/326 |
| 4,126,222 | 11/1978 | Aust | 206/326 |
| 4,170,298 | 10/1979 | Dorn . | |
| 4,185,741 | 1/1980 | Schiff et al. | 206/326 |
| 4,398,902 | 8/1983 | Mangum . | |
| 4,619,362 | 10/1986 | Crowe et al. . | |
| 4,646,959 | 3/1987 | Sheffer | 229/8 |

*Primary Examiner*—David T. Fidei

*Attorney, Agent, or Firm*—Jeffers, Hoffman & Niewyk

[57] ABSTRACT

An L-shaped shipping container for packaging chairs and other articles of furniture is provided. The container includes a bottom tray, a body portion and a cover. The body portion of the container includes side flaps which are folded laterally inwardly to impart additional strength and rigidity to certain corners of the body. The configuration of the assembled container also provides reinforcement to the top and a front shelf portion of the container. The configuration of the container further enables the cover to be held in place on the body by frictional engagement with said body. The assembled shipping container has no protruding flaps or panels that must be fastened down prior to closure, and therefore the container may be passed through automatic or semi-automatic bending machines for final closure.

10 Claims, 3 Drawing Sheets

FURNITURE CONTAINER

BACKGROUND OF THE INVENTION

The present invention relates to shipping containers for articles of furniture such as chairs and other similarly shaped objects, and in particular to shipping containers of L-shaped design.

L-shaped containers for shipping chairs and the like, have long been known in the industry. Certain containers, such as those disclosed in U.S. Pat. Nos. 4,111,301 and 4,619,362 are made from a one-piece paperboard blank. Numerous other patents such as U.S. Pat. Nos. 4,098,401 and 4,398,902 illustrate containers assembled from two pieces of paperboard blank, generally comprising a body portion with bottom flaps, and a separate cover portion. Other references such as U.S. Pat. Nos. 1,686,834 and 1,188,825 show L-shaped shipping containers formed from three or more separate paperboard components.

Although there have been significant improvements in the design of L-shaped shipping containers, the problems of economy and strength of the container persist. The prior art containers typically require a significant amount of labor in the stages of assembling the container to receive the article of furniture, and sealing the container for shipment. It may be necessary for an assembly line worker to individually cut and/or fold numerous flaps and panels, and then to tape or staple these flaps and/or panels into their appropriate positions. Additionally, it is often necessary to repeat the process with a separate piece of board, such as a cover, and to glue or staple this portion to the body portion. The prior art containers have not been conducive to an automated banding process, and hence, the overall cost of the containers remains high. Additional costs are added during the unpacking stage when the disassembly of the container can require a significant amount of a worker's time removing staples, tape and the like. Many of the prior art containers also use an abnormally large amount of paperboard, either as waste generated by the cutting of the blank, or as extra reinforcing material required due to the lack of rigidity resulting from the particular construction.

Therefore, it is desired to develop a container blank that may be cut from a piece of paperboard while generating little or no waste of board. It is also desired to develop a configuration for that blank that imparts strength at the essential corners of the container so that the possibility of damage to the article of furniture during transit is greatly reduced. Additionally, it is desired to develop a paperboard container that may be assembled, and banded, and eventually unpacked at low cost.

SUMMARY OF THE INVENTION

The present invention overcomes the disadvantages of the prior art by providing an L-shaped shipping container that may be automatically banded and does not require the use of any tape or staples. The container is constructed of a design that eliminates the waste of paperboard during the cutting of the board, and at the same time may be folded into a configuration that provides strength and rigidity to the corners of the container.

The unique configuration of applicants container allows it to be easily assembled and folded into its appropriate final shape. When the carton has been assembled in this manner, there are no protruding or extending panels or flaps that need to be fastened down by such techniques as taping or stapling. As a result of this manner of closure, the container may easily be passed through an automatic banding machine to reliably secure it for shipping. It is not necessary for assembly line workers to individually staple down the associated flaps and to tape the container shut, as is a common practice at the present time. The present configuration is also conducive to the use of foam-in-place packaging systems, and thus eliminates the inventory problem of inner pack pads. The design of the present container also provides greater strength at the corners of the container.

Accordingly, in one form of the invention, there is provided an L-shaped shipping container comprising a container body blank, a cover, and a conventional bottom tray. The container body includes conventional front, side, and rear panels. The side panels have an upper portion and a lower portion, which impart the L-shape to the container. The front panel is of lesser vertical dimension than the rear panel, and contains a front shelf panel foldably attached to its upper edge. The side panels include side shelf panels foldably attached to the lower portions of said side panels, at substantially the same vertical dimension as the front shelf portion. The side panels also include side flaps which fold laterally inwardly to impart strength and rigidity to the container. The cover is placed on the container body in a manner such that the side flaps are held in position simply by the weight and configuration of the cover, and without the necessity of any taping or stapling. The cover contains a leading panel, an upper front panel, a top panel and a rear panel. When the shipping container has been fully assembled, the leading panel is disposed underneath the front shelf panel. The front shelf panel is held in place by frictional engagement with the upper front panel of the cover. This frictional engagement enables the front shelf panel to remain securely in position, without the necessity of any additional sealing requirements prior to passage of the container through an automatic or semi-automatic banding machine.

One advantage of the present invention is that it permits L-shaped shipping containers to be banded with the use of automatic or semi-automatic banding machines.

Another advantage of the present invention is that it has a configuration that imparts greater strength and rigidity to shipping containers than has heretofore been present in such containers.

A further advantage of the present invention is that it is not necessary to manually tape, paste, glue or staple any flaps or panels in the banding process, thus effecting significant cost savings over prior containers.

A still further advantage of the present invention is that the bands may be easily removed when the container has reached its destination point, with the exercise of little labor or effort. It is not necessary to engage in the time- consuming process of peeling tape or removing staples.

Another advantage of the present invention is that the unique configuration of the container body and the cover enable them to be easily cut from a section of paperboard, resulting in little or no waste of said paperboard.

Yet another advantage of the present invention is that it enables foam-in-place packaging systems to be used, which eliminates the inventory problem associated with inner pack pads.

The present invention, in one form thereof, comprises an L-shaped shipping container comprised of a body portion, cover portion and a bottom tray. The container body is formed from a paperboard blank having a front panel, two L-shaped side panels and a rear panel, said panels being vertically disposed and interconnected by fold lines. The rear panel has a greater vertical dimension than the front panel, and the side panels have an upper portion and a lower portion. The side panel lower portions are of substantially the same vertical dimension as the front portion, and the side panel upper portions are of substantially the same vertical dimension as the rear panel. The front panel has a shelf panel foldably attached to its upper edge, and the side panel lower portions have side shelf panels foldably attached to their respective upper edges. The rear panel has a top panel foldably attached to its upper edge and likewise the side wall upper portions have side top panels foldably attached to their respective upper edges. A pair of side flaps are disposed on respective vertical edges of the upper portion of the side panels. These side flaps have an upper edge substantially coplanar with the upper edges of the side panel upper portions and the upper edge of the rear panel. These side flaps further include side flap top panels foldably attached to the side flap upper edges. When the side flaps are folded laterally inwardly in the preferred embodiment of this invention, the side flap top panels are disposed directly beneath the side top panels foldably attached to the upper edges of the side panel upper portions. This arrangement provides additional reinforcement to the top of the container. The side flap lower edges are preferably disposed at an acute angle with respect to the shelf panels of the side panel lower portions.

The cover is comprised of a leading panel, an upper front panel, a top panel, and means for securing said cover to the container body. The leading panel is slidably inserted below the front shelf panel of the container body. The means for securing the cover to the container body, in a preferred form thereof, comprises an upper tray including the rectangular top panel with side panels downwardly disposed along the back and two sides of the top panel. The rectangular top panel and the side panels are dimensioned to fit snugly over the upper edges of the rear panel and the side panel upper portions of the container body.

The bottom tray is of conventional design, and typically comprises a rectangular bottom panel having four upstanding side flaps foldably attached to the respective four sides of the bottom panel. The bottom tray is dimensioned so that the four sides of the container body, namely the front panel, two side panels, and rear panel, fit snugly within the four upstanding side walls of the bottom panel.

When the container has been assembled in the above manner, there are no protruding flaps or panels. This configuration leads to easy passage through a banding machine, as well as the attendant advantages described previously.

DETAILED DESCRIPTION OF THE PREFERRED EMBODIMENT

Figure 1:
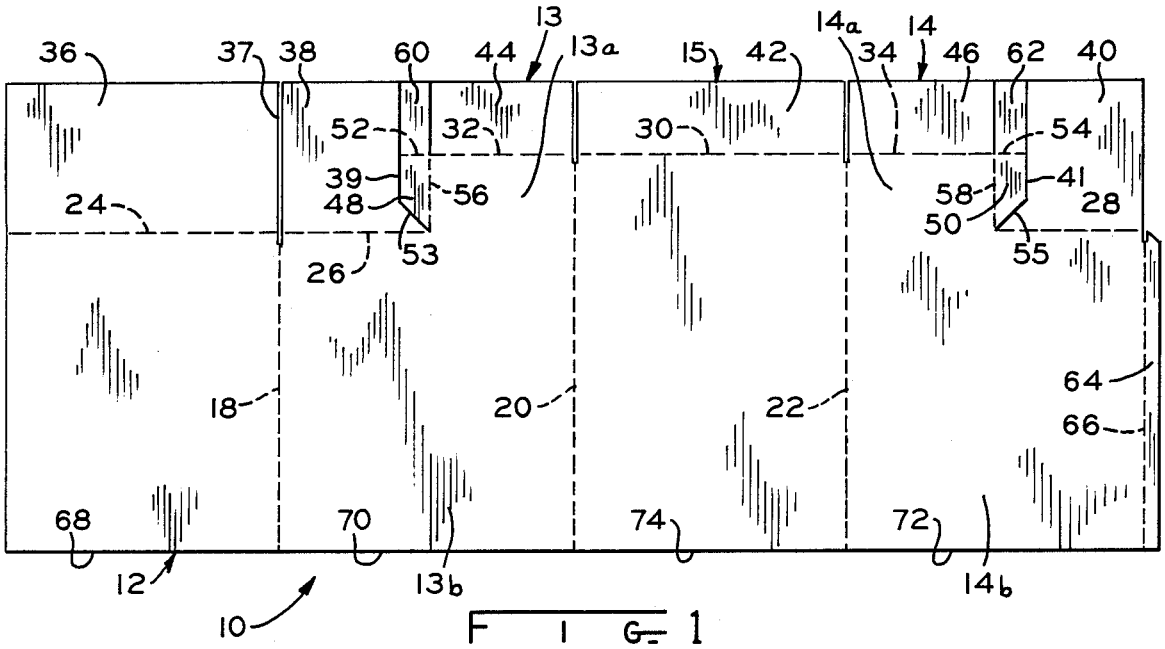
FIG. 1 is a plan view of the blank for the container body.
Figure 4:
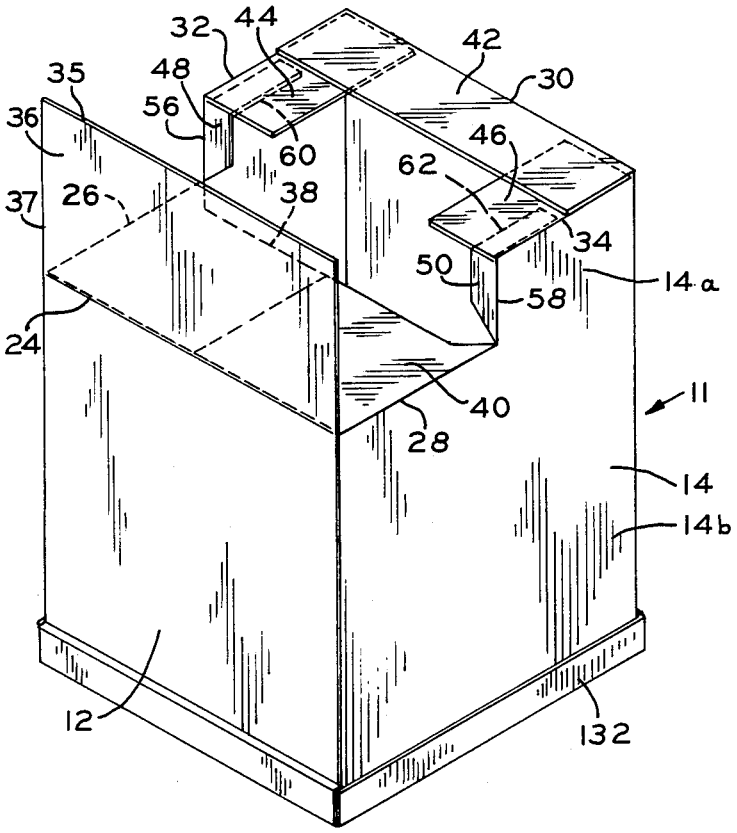
FIG. 4 is a perspective view of the container body on the bottom tray with the front shelf panel shown vertically extended from the lower front panel, and with the side flaps folded inwardly.
Figure 5:
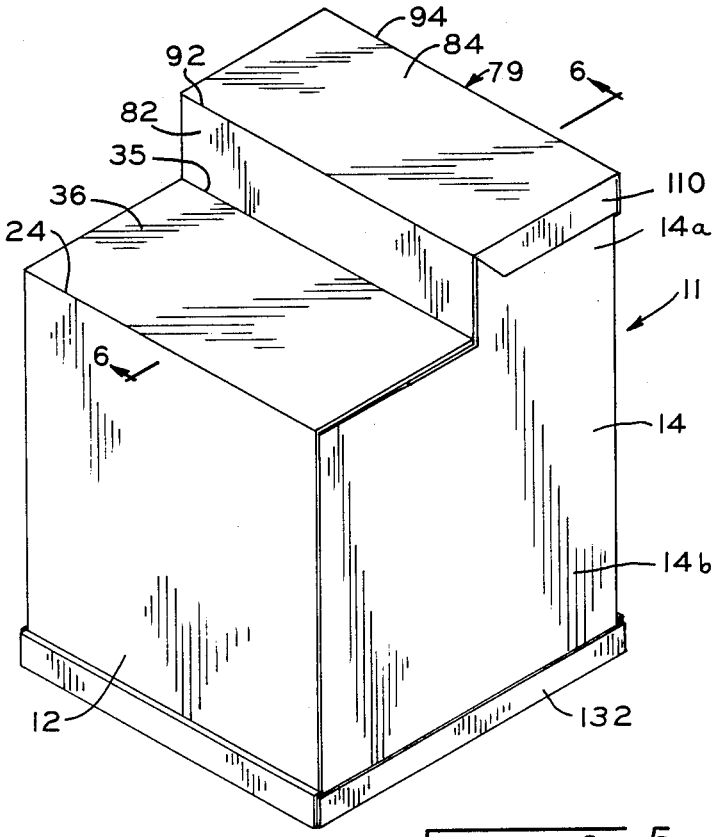
FIG. 5 is a perspective view of the assembled container with the cover in place and the front shelf panel folded into place.
Figure 6:
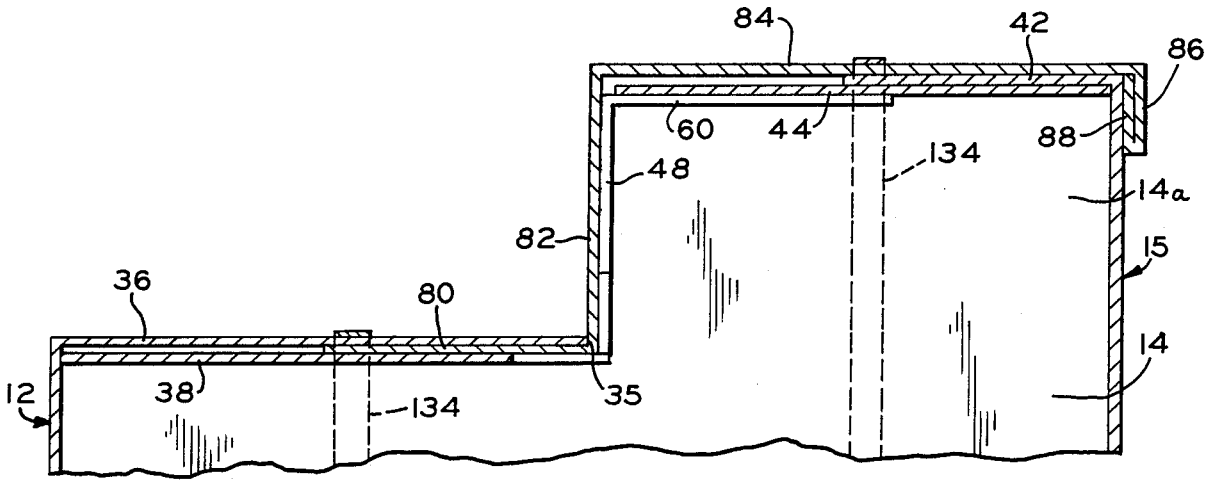
FIG. 6 is an enlarged side sectional view of the upper portion of the assembled container showing the bands in broken lines.

The blank 10 for the container body 11 is shown in FIG. 1. The blank is divided into a lower front panel 12, L-shaped side panels 13, 14 and rear panel 15 by fold lines 18, 20, and 22. Side panels 13, 14 have an upper portion **13*a*, 14*a* and a lower portion 13*b*, 14*b* which impart the L-shape in the assembled container, as best shown in FIGS. 4 and 5. Front panel 12 and side panel lower portions 13*b*, 14*b* are of substantially the same vertical dimension and have upper edges 24, 26, 28 that lie substantially in the same horizontal plane. Panels 12, 13, 14 and 15 have lower edges 68, 70, 72, and 74, respectively, that lie substantially in the same horizontal plane in a preferred embodiment of the invention. A front shelf panel 36 is foldably attached to the upper edge 24 of lower front panel 12, and side shelf panels 38, 40 are foldably attached to the upper edges 26, 28 of side panel lower portions 13*b*, 14*b*. Side shelf panel 38 is separated from front shelf panel 36 on blank 10 by transverse slit 37. Rear panel 15 and side panel upper portions 13*a*, 14*a* are of substantially the same vertical dimension and have upper edges 30, 32, 34 that lie substantially in the same horizontal plane. A top panel 42 is foldably attached to the upper edge 30 of rear panel 15, and side top panels 44, 46 are foldably attached to the upper edges 32, 34 of side panel upper portions 13*a*, 14*a*. Side panel lower portion 14*b* may also have a fold panel 64 attached along fold line 66, by which side panel 14 may be attached to the lower front panel 12 during assembly of the container body 11**.

Side flaps 48, 50 are foldably attached to respective vertical edges 56, 58 of side panel upper portions **13*a*, 14*a* and have upper edges 52, 54 that lie substantially in the same horizontal plane as the aforementioned upper edges 30, 32, 34. Side flaps 48, 50 have top panels 60, 62, foldably attached to side flap upper edges 52, 54. Side flap 48 is further defined by transverse slit 39 which separates side flap 48 and top panel 60 from side shelf panel 38. Side flap 50 is further defined by transverse slit 41 which separates side flap 50 and top panel 62 from side shelf panel 40. Side flaps 48, 50 are further defined at their lower edges by slits 53, 55 which are disposed at an acute angle with respect to side shelf panels 38, 40**.

Figure 3:
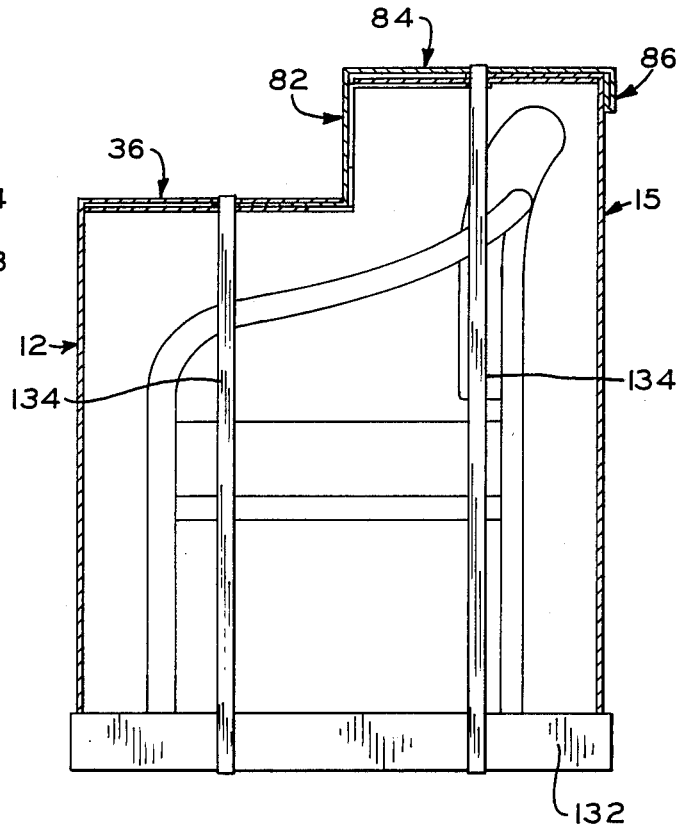
FIG. 3 is a side partially sectional view of the assembled container, shown with bands attached and a chair inside the container.

A conventional bottom tray 132 is provided (FIGS. 3, 4, 5). Tray 132 may also be cut from paperboard. The bottom tray consists of a rectangular base portion having upstanding side flaps 132 attached to the respective side edges of said base. Bottom tray 132 is dimensioned so that the four sides of the container body, namely lower front panel 12, L-shaped side panels 13, 14, and rear panel 15 fit snugly within the four upstanding side walls 132 of bottom tray 132.

Container blank 10 is initially folded along lines 18, 20, 22 into container body 11. In a preferred embodiment, a fold panel 64 is folded inwardly and disposed against the inside surface of lower front panel 12 which is glued. Body 11 is then inserted into bottom tray 132. Side shelf panels 38, 40 are folded inwardly along side edges 26, 28 (FIG. 4).

Figure 2:
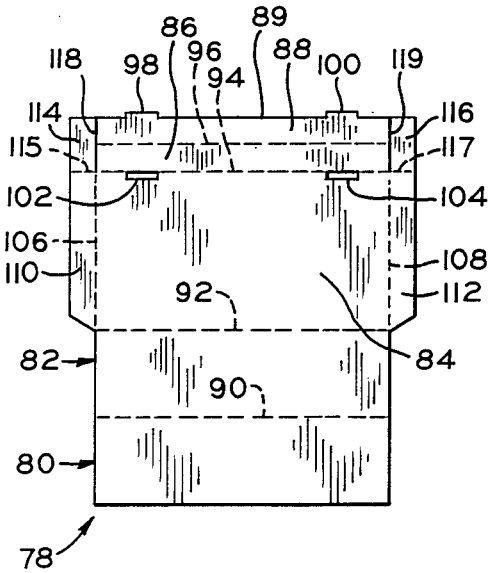
FIG. 2 is a plan view of the blank for the container cover.

The blank 78 for the cover 79 is shown in FIG. 2. Blank 78 is divided into a leading panel 80, an upper front panel 82, a cover top panel 84, a rear panel 86, and a fold-back panel 88. These portions of blank 78 are interconnected by parallel fold lines 90, 92, 94, 96. Foldably attached to top panel 84 along transverse fold lines 106, 108 are top section side flaps 110, 112. Side flaps 110, 112 have securing flaps 114, 116 foldably attached to side flaps 110, 112 along side flap edges 115, 117. Securing flaps 114, 116 are further defined by transverse slits 118, 119 separating them from rear panel 86 and fold-back panel 88. Fold-back panel 88 has tabs 98, 100 extending from its outer edge 89. Cover top panel 84 has corresponding slots 102, 104 to receive tabs 98, 100. When cover 79 is assembled, side flaps 110, 112 are folded inwardly along fold lines 106, 108 until they are approximately perpendicular to top panel 84. Securing flaps 114, 116 are then folded inwardly until their respective edges, defined by transverse slits 118, 119, abut fold line 94. Fold-back panel 88 is folded inwardly along fold lines 94, 96 until tabs 98, 100 face slots 102, 104. In this position, securing flaps 114, 116 are positioned between fold-back panel 88 and rear panel 86, and are retained in this position when tabs 98, 100 are inserted into slots 102, 104.

Figure 7:
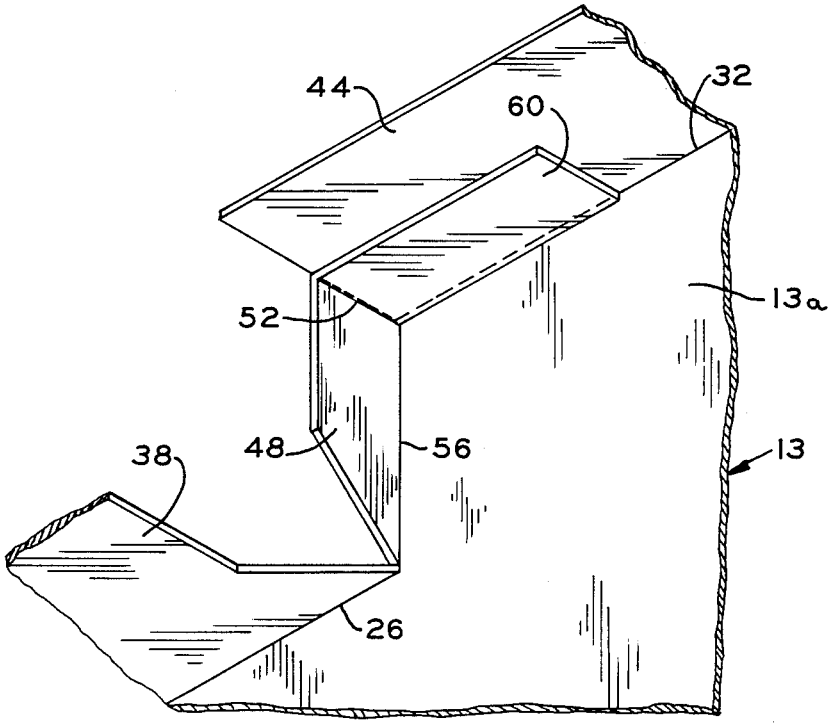
FIG. 7 is a perspective view of a portion of the container body showing one of the side flaps folded laterally inwardly and supporting a side top panel.

Referring now to FIG. 4, container body 11 has been inserted into bottom tray 132. Side shelf panels 38, 40 have been folded inwardly along side panel upper edges 26, 28. Top panel 42 and side top panels 44, 46 have been folded inwardly along edges 30, 32, 34, with top panel 42 disposed above and in abutting relationship with side panels 44, 46. Side flaps 48, 50 have been folded laterally inwardly along vertical side edges 56, 58 and side flap top panels 60, 62 (shown in dotted lines) have been positioned directly beneath and in abutting relationship with side top panels 44, 46. This may also be seen in FIG. 7. When folded in this manner, side flaps 48, 50 and side flap top panels 60, 62 impart additional strength and rigidity to the upper portions of container body 11.

Cover 79 is then placed upon container body 11 as shown in FIG. 5. Top panel 84 of cover 79 is positioned directly above and in abutting relationship with top panel 42 of container body 11. Top section side flaps 110, 112 and top rear panel 86 fit snugly over side panel upper portion **14*a*, side panel upper portion 13*a*, and rear panel 15, respectively. Upper front panel 82 is folded downwardly along fold line 92 until it abuts side flaps 48, 50. Leading panel 80 is then folded along fold line 90 into a position substantially perpendicular with upper front panel 82, at which point leading panel 80 rests upon upper edges 26, 28 of side panel lower portions 13*b*, 14*b* and upon side shelf panels 38, 40. Front shelf panel 36 is then folded downwardly from the position shown in FIG. 4 to the horizontal position shown in FIG. 5. For best results, front shelf panel 36 is dimensioned so that when placed in this horizontal position, it extends the entire length of the upper edges 26, 28 of side panel lower portions 13*b*, 14*b*, and its free leading edge 35 (FIG. 6) is in direct contact with upper front panel 82. As illustrated in FIGS. 1, 4, 5 and 6, upper edge 26 of side panel lower portion 13*b* extends from fold line 18 of said panel lower portion 13*b* to side edge 56 of side panel upper portion 13*a*. Similarly, upper edge 28 of side panel lower portion 14*b* extends from fold line 66 of said side panel lower portion 14*b* to side edge 58 of side panel upper portion 14*a*. This contact with panel 82 creates a frictional engagement with said panel 82, which assists in retaining the shipping container in the position shown in FIG. 5. The assembled shipping container, as shown in FIG. 5, has no protruding panels or flaps that need to be attached by any of the conventional means such as taping or stapling. The container of FIG. 5 may be passed directly through an automatic or semi-automatic banding machine, and bands 134 may be applied at any suitable positions, such as those positions shown in FIG. 6**.

While this invention has been described as having a preferred design, it will be understood it is capable of further modification. This application is, therefore, intended to cover any variations, uses or adaptations of the invention following the general principles thereof and including such departures from the present disclosure as come within known or customary practice in the art to which the invention pertains and fall within the limits of the appended claims.

What is claimed is:

1. A blank for a body portion of a shipping container comprising:

a lower front panel, two L-shaped side panels and a rear panel, said panels being interconnected by parallel fold lines, each of said panels having lower edges that are substantially colinear, said side panels each having an upper portion and a lower portion, upper edges of said side panel lower portions and an upper edge of said lower front panel being substantially colinear, upper edges of said side panel upper portions and an upper edge of said rear panel being substantially colinear;

a front shelf panel foldably attached to said upper edge of said lower front panel, side shelf panels foldably attached to said upper edges of said side panel lower portions, a top panel foldably attached to an upper edge of said rear panel, and side top panels foldably attached to upper edges of said side panel upper portion; and a pair of side flaps each having an upper edge and side edges foldably attached along a side edge to a side edge of a respective side panel upper portion, said upper edges of said side flaps being substantially colinear with said upper edges of said side panel upper portions, said side flaps having lower edges, said side flaps further having side flap top panels foldably attached to said upper edges of said side flaps, said front shelf panel having a free edge that is spaced from said upper edge of said lower front panel by a distance substantially equal to the length of said upper edge of said side panel lower portion between the fold line of said side panel lower portion and the side edge of the respective side panel upper portion.

2. A blank according to claim 1, wherein said lower edges of said side flaps are disposed at an acute angle with respect to said side shelf panels.

3. A blank according to claim 1, wherein one of said vertical side edges of one of said side panel lower portions includes a fold panel foldably attached to said vertical side edge.

4. A shipping container for articles of furniture comprising a bottom tray including a rectangular bottom panel having four upstanding side flaps attached to said rectangular bottom panel;

a container body adjoining said bottom tray including: a lower front panel; two L-shaped side panels; a rear panel, said panels being vertically disposed and interconnected by fold lines, said side panels each having an upper portion and a lower portion, upper edges of said side panel lower portions and an upper edge of said lower front panel lying substantially in the same horizontal plane, upper edges of said side panel upper portions and an upper edge of said rear panel lying substantially in the same horizontal plane; a front shelf panel attached to said upper edge of said lower front panel and folded inwardly; side shelf panels attached to said upper edges of said side panel lower portions and folded inwardly, said front and side shelf panels being horizontally disposed; a pair of side flaps foldably attached along a vertical side edge to a vertical side edge of said side panel upper portion and being folded inwardly along said vertical side edges, said upper edges of said side flaps lying substantially in the same horizontal plane as said upper edges of said side panel upper portions and said rear panel; and a top panel foldably attached to said upper edge of said rear panel and folded forwardly; side top panels foldably attached to said upper edges of said side panel upper portions and folded inwardly; and side flap top panels foldably attached to said upper edges of said side flaps; said top panel, side top panels and side flap top panels being horizontally disposed wherein said side flap top panels are disposed beneath and support said top and side top panels; and a cover member positioned on and secured to said container body.

5. A shipping container according to claim 4 wherein said cover member includes a plurality of panels that fit over said top panel and said side top panels of said container body.

6. A shipping container according to claim 5 wherein said panels comprise a leading panel, an upper front panel, a cover top panel and a rear panel, said leading panel being horizontally disposed between said front shelf panel and said side shelf panels, said cover top panel being horizontally disposed above said top panel and said side top panels, said upper front panel being vertically disposed and abutting said side flaps and said rear panel being downwardly disposed from said cover top panel.

7. A shipping container according to claim 6 wherein an edge of said front shelf panel is in frictional engagement with said upper front panel of said cover member.

8. A shipping container according to claim 6 wherein said front shelf panel is in engagement with said cover panel leading portion and in frictional engagement with said upper front panel of said cover.

9. A shipping container according to claim 4 wherein one of said vertical side edges of one of said side panel lower portions includes a fold panel foldably attached to said vertical side edge whereby said fold panel bridges said lower front panel and said side panel when said container body is fully assembled.

10. A shipping container according to claim 4 wherein said side flaps include lower edges that are disposed at an acute angle with respect to said side shelf panels.

* * * * *